US005642633A

United States Patent [19]

Pedall

[11] Patent Number: 5,642,633

[45] Date of Patent: Jul. 1, 1997

[54] ELASTIC BAND, IN PARTICULAR UPHOLSTERY BAND

[75] Inventor: Günter Pedall, Munchberg, Germany

[73] Assignee: Münchberger Band- Und Gurtweberei GmbH, Münchberg, Germany

[21] Appl. No.: 600,923

[22] PCT Filed: Jul. 8, 1994

[86] PCT No.: PCT/EP94/02249

§ 371 Date: Feb. 27, 1996

§ 102(e) Date: Feb. 27, 1996

[87] PCT Pub. No.: WO95/06149

PCT Pub. Date: Mar. 2, 1995

[30] Foreign Application Priority Data

Aug. 27, 1993 [DE] Germany ..... 43 28 951.7

[51] Int. Cl.[6] ..... D04B 23/08

[52] U.S. Cl. ..... 66/193; 66/198; 442/306; 442/312

[58] Field of Search ..... 428/253; 66/193, 66/198

[56] References Cited

U.S. PATENT DOCUMENTS 4,248,064 2/1981 Odham ..... 66/192
5,125,246 6/1992 Shytles ..... 66/193

FOREIGN PATENT DOCUMENTS 469702 12/1928 Germany .
967570 8/1964 United Kingdom .

*Primary Examiner*—James J. Bell
*Attorney, Agent, or Firm*—Banner & Witcoff, Ltd.

[57] ABSTRACT

The invention pertains to an elastic band, in particular for upholstery on the backrests of chairs, etc. The band has rubber threads (2, **2*a*, 2*b*) running in its longitudinal direction. On both sides of the rubber threads, running transverse to them, are from and back woof threads (4, 6) made of inelastic textile material. The band is designed for crochet production. It has weave threads made of inelastic material, with each rubber thread (2, 2*a*, 2*b*) having two weave threads (7, 8) one of which, as stationary weave thread (7), always loops around the same rubber thread as well as the front and back woof threads (4, 6). The other, the jump weave thread (8) makes loops around a first rubber thread (2*a*) and around a small, odd number of successive from and back woof threads (4, 6). It then jumps to a neighboring second rubber thread (2) and with it makes an equal number of successive front and back woof-thread loops. It then jumps back to the first rubber thread (2*a***), etc.

5 Claims, 2 Drawing Sheets

ELASTIC BAND, IN PARTICULAR UPHOLSTERY BAND

The invention pertains to an elastic band, produced by crocheting having the features recited in the preamble of claim 1. The invention is applicable particularly to an upholstery band, as is required for the backrests of chairs, armchairs or couches. Elastic bands, made by crocheting, having the features recited in the preamble of claim 1 are known from the documents U.S. Pat. No. 4,248,064 and GB-A-967 570. There is provided one stationary weave thread for each rubber thread, which loops around the same rubber thread as well as the front and back weft thread. For upholstery, the bands are attached to wooden frames by tacks. In most cases also these threads will be cut off. The band then unravels from these points during use.

The upholstery bands cross one another within the upholstery frame. During use they stretch and slip relative to one another, producing a disturbing sound if they are conventional, relatively rough bands.

The present invention is to provide an elastic band meeting the following conditions at one and the same time:

1. Starting from not covered rubber threads, the band is to be producible on a single machine, namely a crocheting machine.

2. The band is to be protected against unravelling, even at damaged locations.

3. The band is to have a smoother surface than conventional ones and therefore not produce any sound during use.

4. The band, while having the same load-carrying capacity as a conventional elastic band, is to be thinner than the latter.

These advantages are attained by a crocheted elastic band according to claim 1.

An exemplary embodiment incorporating further features of the invention will be described below with reference to the drawings.

FIG. 1 is a portion of a crocheted elastic band according to the invention, depicted in highly schematized form.

FIG. 1*a* is a schematized cross section of the band in FIG. 1, parallel to the weft threads.

Figure 1:
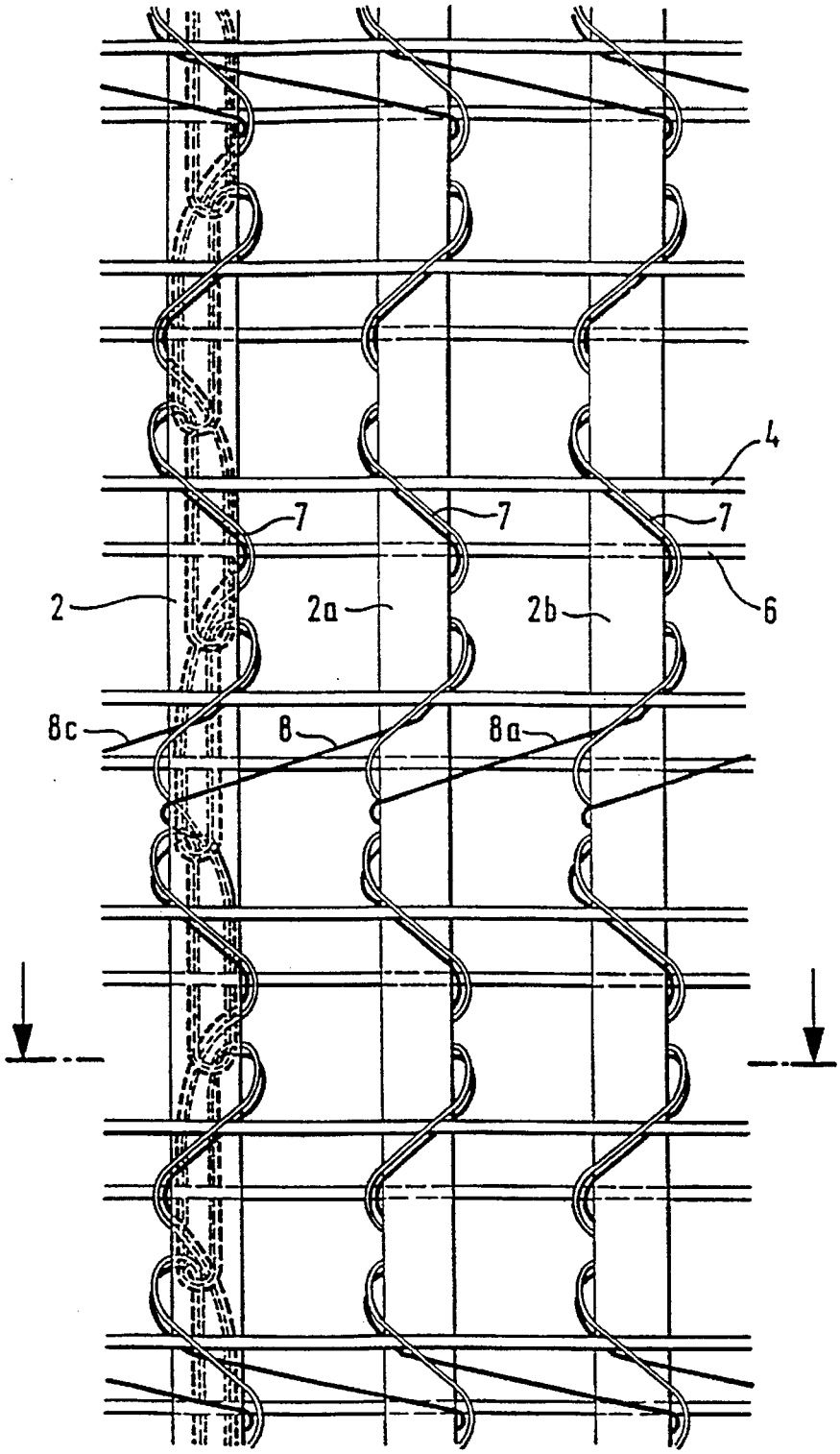
Figure 1A:
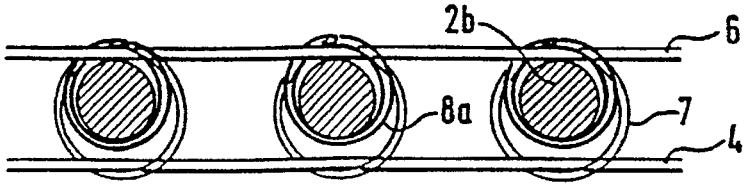

FIG. 1 depicts in highly schematized form a small portion of a crocheted elastic band according to the invention. The band has rubber threads 2, 2*a*, 2*b*, by which threads made of rubber or artificial rubber, generally threads of high elasticity, are meant. The band has weft threads running transversely to them, namely front weft threads 4 and back weft threads 6. The designations "front" and "back" correspond to the representation in FIG. 1. These weft threads are made of relatively inelastic textile material. No loops or other form of covering is provided around the rubber threads 2, 2*a*, 2*b*, saving a respective operation.

FIG. 1 further shows that each of the rubber threads 2, 2*a*, 2*b* together with the front and back weft threads 4, 6 has loops of one of the weave threads 7 around it. Since these weave threads 7 make loops along only one single rubber thread, they are therefore referred to here as "stationary" weave threads.

Also shown are weave threads 8, 8*a*, 8*c* crossing from one rubber thread to another and therefore referred to here as "jumping" weave threads. These jumping weave threads loop around the rubber threads 2, 2*a*, 2*b* on the one hand, around the back weft threads 6 on the other hand, but not around the front weft threads 4. Along the rubber thread 2*a* the jumping weave thread 8 (at the top in FIG. 1) loops around three successive back weft threads 6 and the rubber thread 2*a*. It then jumps leftwards to the neighbouring rubber thread 2, loops around it at three successive crossing points of the rubber thread 2 and only the back weft thread 6. The jumping weave thread 8 then jumps back to the original rubber thread 2*a*, loops around it at three further crossing points in the above-described manner and jumps back again to the same neighbouring rubber thread 2 and so on.

A jumping weave thread 8*a* at the right side of the weave thread 8 is guided in the same way. At the left in FIG. 1 a further jumping weave thread 8*c* is to be seen, crossing over from a rubber thread (not illustrated) on the left. The same applies for the righthand side of FIG. 1. These jumping weave threads are used throughout the width of the band.

Instead of looping around three successive crossing points as illustrated in FIG. 1, the jumping weave threads may loop around another odd number of successive crossing points, e.g. three to nine.

Since the weave threads (8, 8*a*, 8*b*,) are guided beneath the from weft threads 4, the latter protect the weave threads from wear in the finished woven band.

The stationary weave threads 7 loop around the two weft threads 4,6 and also around the jumping weave threads 8, 8*a*, 8*c* and protect particularly the jumping weave threads at the front and back from chafing.

It follows from the illustrated loop system that the finished band displays less roughness.

Figure 2:
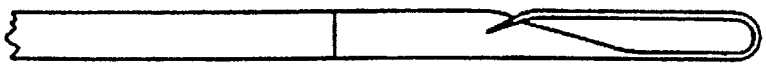
FIG. 2 is a side view of the head end of a conventional bearded needle.
Figure 3:
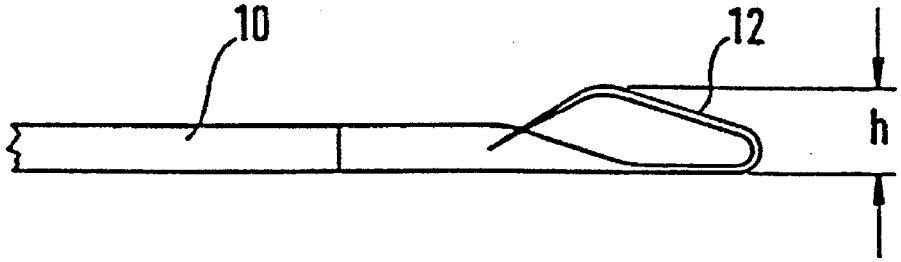
FIG. 3 is a side view of the head end of a bearded needle suited for producing a crocheted elastic band according to the invention.

FIG. 2 shows the head end of a normal patent needle for crocheting machines. FIG. 3 shows the head end of a patent needle 10 suited for producing an elastic band according to the invention. The height h of the beard 12 is here made larger than in normal patent needles by buckling. This is appropriate because the jumping weave threads jump over two needles. By this means they are conducted to the patent needles at angles, which would impede or prevent insertion in normal needle heads.

I claim:

1. An elastic band produced by crocheting, in particular an upholstery band, the elastic band having a longitudinal direction and comprising:

rubber threads running in the longitudinal direction;

front and back weft threads made of relatively inelastic textile material, said front weft threads located on one side of the rubber threads and running transversely thereto, and said back weft threads located on the opposing side of the rubber threads and running transversely thereto;

weave threads made of relatively inelastic textile material;

wherein for each rubber thread, a first weave thread is provided which always loops around the same rubber thread and the front and back weft threads associated with the same rubber thread;

wherein for each rubber thread a second weave thread is provided which loops around only its respective rubber thread and the weft thread on one side of the rubber thread; and wherein each second weave thread repeatedly: loops around a first rubber thread and a small, odd number of successive weft threads on said one side of the rubber threads, then jumps to a second and neighboring rubber thread and loops with it and an equal number of small, odd number of successive weft threads on said one side of the rubber threads, and then jumps back to the first rubber thread.

2. An elastic band as claimed in claim 1, wherein no covering is provided around the rubber threads.

3. An elastic band as claimed in claim 1, wherein the weft threads on said one side of the rubber threads are the back weft threads.

4. An elastic band as claimed in claim 3, wherein the small, odd number of loops made around the back weft threads between jumps is between three and nine.

5. An elastic band as claimed in claim 4, wherein the small, odd number of loops made around the back weft threads between jumps is three.

* * * * *